US007811101B2

(12) United States Patent
Tang et al.

(10) Patent No.: US 7,811,101 B2
(45) Date of Patent: Oct. 12, 2010

(54) RETRACTABLE MEMORY DRIVE

(75) Inventors: Choon Tak Tang, Irvine, CA (US); George Shiu, South Pasadena, CA (US)

(73) Assignee: Kingston Technology Corporation, Fountain Valley, CA (US)

( * ) Notice: Subject to any disclaimer, the term of this patent is extended or adjusted under 35 U.S.C. 154(b) by 0 days.

(21) Appl. No.: 12/132,396

(22) Filed: Jun. 3, 2008

(65) Prior Publication Data

US 2008/0233776 A1 Sep. 25, 2008

Related U.S. Application Data

(63) Continuation-in-part of application No. 11/688,845, filed on Mar. 21, 2007, now abandoned.

(51) Int. Cl.
*H01R 13/44* (2006.01)

(52) U.S. Cl. ..... 439/131; 439/95; 361/737

(58) Field of Classification Search ..... 439/131, 439/76.1, 95, 607
See application file for complete search history.

(56) References Cited

U.S. PATENT DOCUMENTS

| | | | | |
|---|---|---|---|---|
| 4,616,764 | A | 10/1986 | Utoh et al. | |
| 6,763,410 | B2 | 7/2004 | Yu | |
| 6,792,487 | B2 | 9/2004 | Kao | |
| 6,979,210 | B2 | 12/2005 | Regen et al. | |
| 7,004,780 | B1 | 2/2006 | Wang | |
| 7,070,425 | B2 | 7/2006 | Regen et al. | |
| 7,090,515 | B2 | 8/2006 | Regen et al. | |
| 7,581,967 | B2 * | 9/2009 | Collantes et al. | 439/131 |
| 2008/0261449 | A1 * | 10/2008 | Ni et al. | 439/607 |
| 2008/0261450 | A1 * | 10/2008 | Nguyen et al. | 439/607 |
| 2008/0278902 | A1 * | 11/2008 | Nguyen et al. | 361/684 |

* cited by examiner

*Primary Examiner*—Hien Vu
(74) *Attorney, Agent, or Firm*—Sawyer Law Group, P.C.

(57) ABSTRACT

A retractable memory drive in accordance with the present invention comprises a top casing, a middle carrier, an electronic device such as a USB thumb drive, and a bottom casing. There are guide rails that allow the middle carrier to remain in an appropriate position. There is also a metal spring clip coupled to the middle carrier for contacting a connector of a device coupled to the drive to provide for improved EMI and ESD protection.

7 Claims, 8 Drawing Sheets

RETRACTABLE MEMORY DRIVE

CROSS-REFERENCE TO RELATED APPLICATION

Under 35 U.S.C. 1.120, this application claims the benefit of priority to U.S. patent application Ser. No. 11/688,842, filed Mar. 21, 2007, now abandoned, all of which is incorporated herein by reference.

FIELD OF THE INVENTION

The present invention relates generally to transferring electronic data and more specifically to a memory drive utilized to transfer electronic data.

BACKGROUND OF THE INVENTION

Memory drives such as drives with USB connectors are frequently utilized to portably transfer electronic data. There are two types of conventional USB drives, one type of drive including a cap to cover the USB connector and another type of drive being a retractable USB drive. USB drives that include a cap are not as convenient because the cap gets in the way during the user's handling of the USB device and it is easy to lose the cap because of repeated handling. Conventional retractable USB drives typically include complicated mechanisms to allow for the extension and retraction of the connector and are typically difficult to manufacture.

To describe some conventional retractable USB drives, refer now to the following:

U.S. Pat. No. 7,004,780

In the retractable plug connector taught in U.S. Pat. No. 7,004,780, a positioning member is mounted onto the PCBA which then extends and retracts the printed circuit board assembly (PCBA) in relation to its casing. The positioning member is a cantilever that has one end attached to the substrate and another end that is free from any attachments. The positioning member also has on it a locking mechanism that works with H shaped locking structures built into the casing.

The device described in U.S. Pat. No. 7,004,780 has problems which are described below. First, the positioning member has to be attached to the substrate. With USB thumb drives getting smaller, there is increasingly less space on the substrate for such an attachment. Second, the overall locking process takes one press of the positioning member to unlock and another press to lock.

U.S. Pat. Nos. 6,979,210, 7,070,425 and U.S. Pat. No. 7,090,515

In U.S. Pat. Nos. 6,979,210, 7,070,425, and 7,090,515, a spring-loaded sliding button 211 is used with detent on the external casing for extending/retracting the USB connector. The claimed thumb drive consisted of at least five components: A top casing 213 with detents implemented in opening for the sliding button which provide detention of USB module when it is extended/retracted, a bottom casing 214 with molded-in tracks/guides, a USB module 301 and a spring-loaded slide button 211 with detents.

U.S. Pat. Nos. 6,979,210, 7,070,425 and U.S. Pat. No. 7,090,515 state that a spring is used to keep the button protruded; however, if such a spring is utilized, then the thickness of the drive will be increased due to implementation of the spring mechanism. Also, the structure of the claimed thumb drive is too complicated for manufacturing.

U.S. Pat. No. 6,792,487

U.S. Pat. No. 6,792,487 teaches a complex sliding mechanism 4. As shown in FIG. 4-1, the sliding mechanism includes many moving parts (at least 8 parts) with a press button 33 connected to a reed 321. It also requires a spring 6, connected between the two wings 421 and fixed parts 34. The sliding mechanism is ejected by means of the springs 6, and settled on the fixed bed 3. This approach is not only complex, but also difficult and very costly to manufacture.

Accordingly, what is desired is to provide a retractable USB drive that is simple, easy to manufacture and more cost-effective than conventional retractable USB drives. The present invention addresses such a need.

SUMMARY OF THE INVENTION

A retractable memory drive in accordance with the present invention comprises a top casing, a middle carrier, an electronic device such as a USB thumb drive, and a bottom casing. A positioning device on the middle carrier has a portion that protrudes outside the casing and operates like a button. The location of the positioning device where the button is located has two key attributes. First, there is a protrusion that acts as a lock with the casing. Second, the area below the button is not rigid and so it gives way when pressure is applied to the button.

The top and bottom casings provide a casing structure which includes two detents. One detent is for locking the device with the connector in the extended position, and one detent for locking the device with the connector retracted in the in position. This allows for just one press of the extended portion of the positioning device to unlock it from its present position. When the device reaches its new position it will automatically lock. There are also guide rails that allow the middle carrier to remain in an appropriate position. There is also a metal spring clip coupled to the middle carrier for contacting a connector of a device to provide for improved EMI and ESD protection.

DETAILED DESCRIPTION

The present invention relates generally to transferring electronic data and more specifically to a memory drive utilized to transfer electronic data. The following description is presented to enable one of ordinary skill in the art to make and use the invention and is provided in the context of a patent application and its requirements. Various modifications to the preferred embodiments and the generic principles and features described herein will be readily apparent to those skilled in the art. Thus, the present invention is not intended to be limited to the embodiments shown, but is to be accorded the widest scope consistent with the principles and features described herein.

Figure 1A:
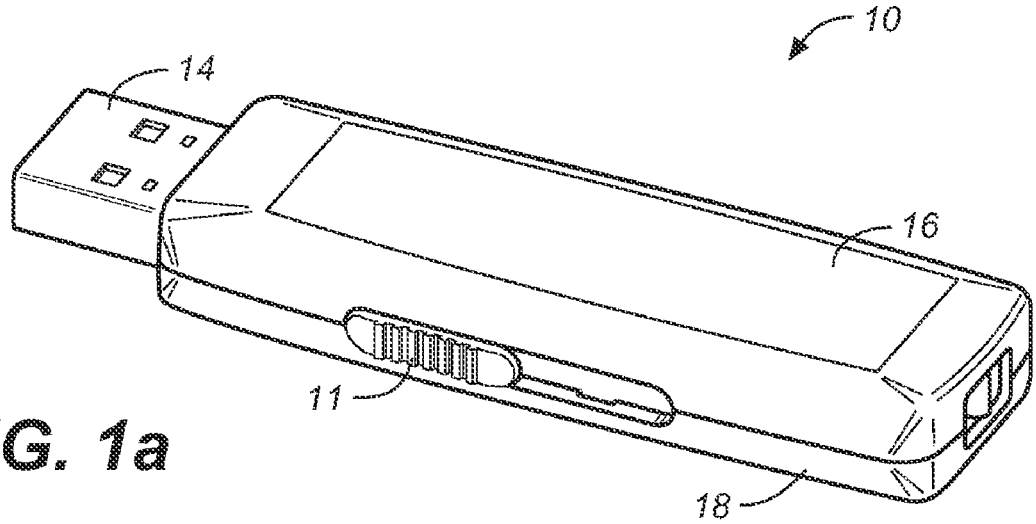
FIGS. 1*a* and 1*b* are a perspective view of a retractable USB drive in accordance with the present invention.
Figure 1B:
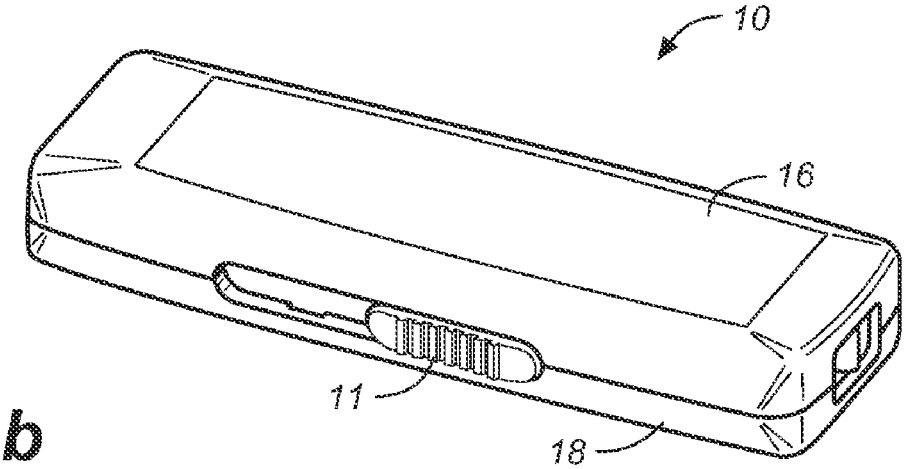

FIGS. 1*a* and 1*b* are a perspective view of a retractable USB drive 10 in accordance with the present invention. Although the present invention will be described in the context of a USB connector, one of ordinary skill in the art readily recognizes that a system and method in accordance with the present invention could be utilized with a variety of connectors utilized with memory devices and that use would be within the spirit and scope of the present invention. A retractable USB drive 10 in accordance with the present invention includes a sliding and locking mechanism for extending and retracting a USB connector and memory device. FIG. 1*a* shows the USB drive 10 in an extended position, in which the activation slide button 11 is in a forward position. In this forward position, the USB connector and memory device 14 is extended from the drive 10.

FIG. 1*b* shows the USB drive 10 in retracted position. When the USB drive 10 is in retracted position, the USB connector and memory device 14 (shown in FIG. 1*a* above) is hidden within the drive 10, and the activation slide button 11 is in a rear position. To describe the features of the USB drive 10, refer now to the following description in conjunction with the figures.

Figure 2:
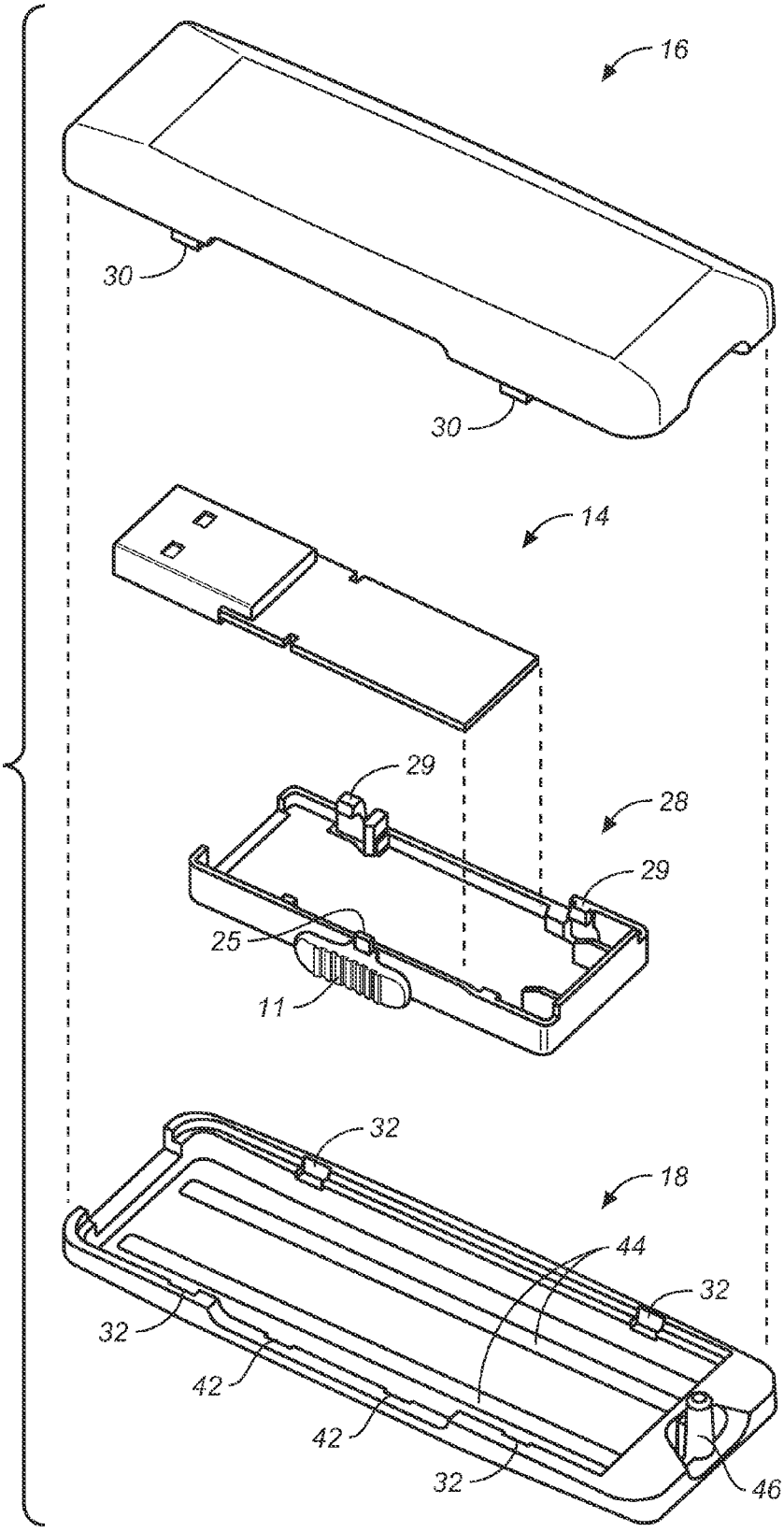
FIG. 2 is an exploded view of the retractable USB drive.

FIG. 2 is an exploded view of the retractable USB drive 10. As is seen, the drive 10 includes an upper casing 16, a lower casing 18, a middle carrier 28, and the USB connector and memory device 14. There are no parts required to couple the USB drive 10 together and hold the USB connector and memory device 14 in place. There are no loose pieces when the top casing 16 is combined with the bottom casing 18. The top casing 16 is coupled to the bottom casing 18 by insertion of protrusions 30 on the upper casing 16 into the indentations 32 on the bottom casing 18. Once insertion is completed, with the USB connector and memory device 14 in place, the upper casing 16 and the lower casing 18 are preferably ultrasonically welded together by means of an ultrasonic tool. It should be understood that other processes could be utilized to couple the upper casing 16 and lower casing 18 together, such as providing a simple latching mechanism, therebetween or the like.

Figure 3A:
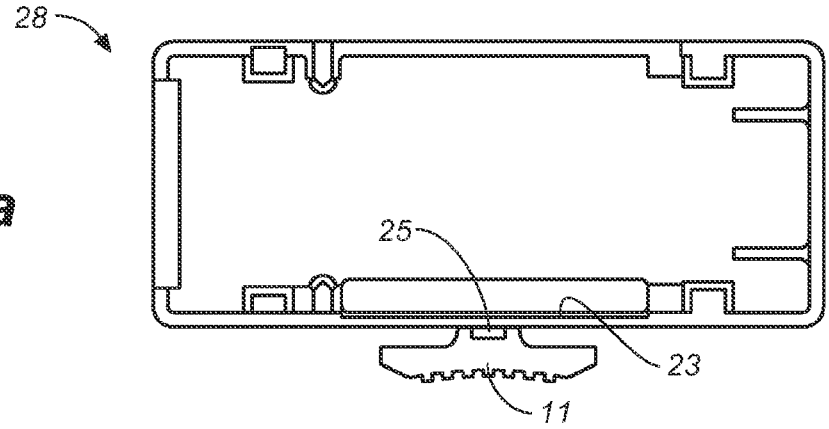
FIGS. 3*a*-3*d* illustrate the operation of the middle carrier.
Figure 3B:
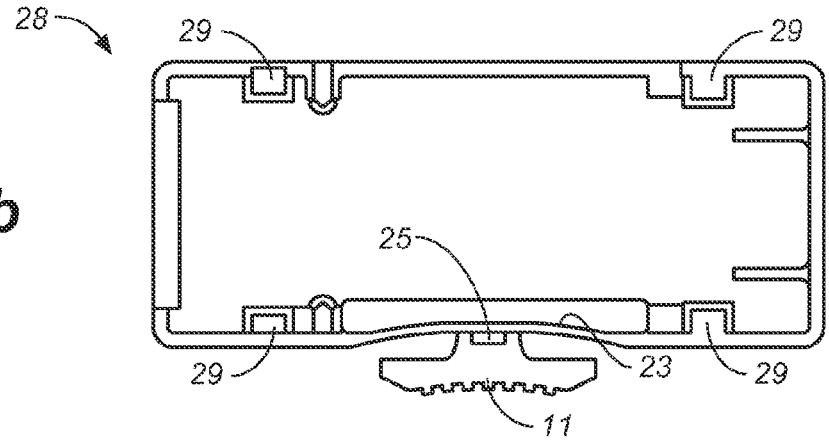

FIGS. 3*a*-3*d* illustrate the operation of the middle carrier 28. As shown in FIGS. 3*a* and 3*b*, the activation slide button 11 extends beyond the casing structure formed by the top casing 16 and bottom casing 18 to allow for button 11 to be pressed. The support 23 for the button 11 is soft and is made, for example, of Polyoxymethylene (POM) material, or the like. The advantages of using POM material is that POM material is very rigid, strong, and has a low coefficient of friction. When there is no pressure on the button 11, as shown in FIG. 3*a*, the support 23 stays straight. When pressure is applied, as shown in FIG. 3*b*, the support 23 gives way.

Figure 3C:
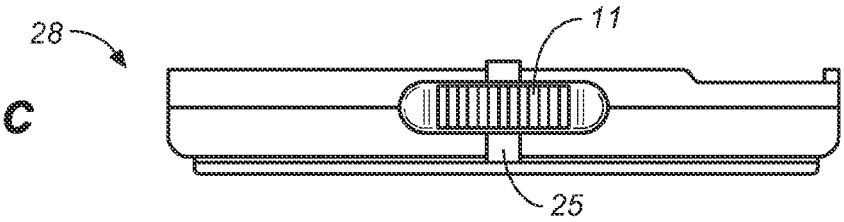
Figure 4A:
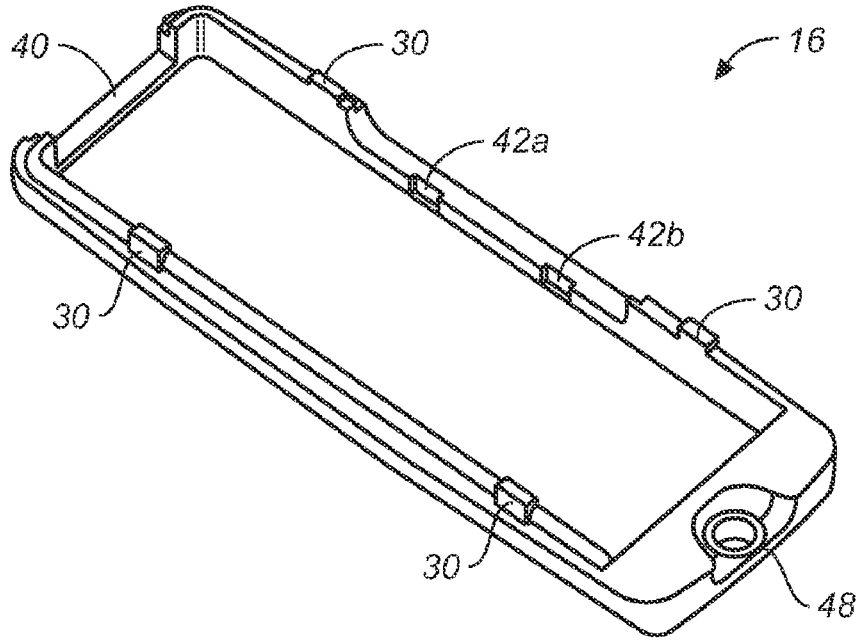
FIG. 4*a* illustrates the inside portion of the top casing.
Figure 4B:
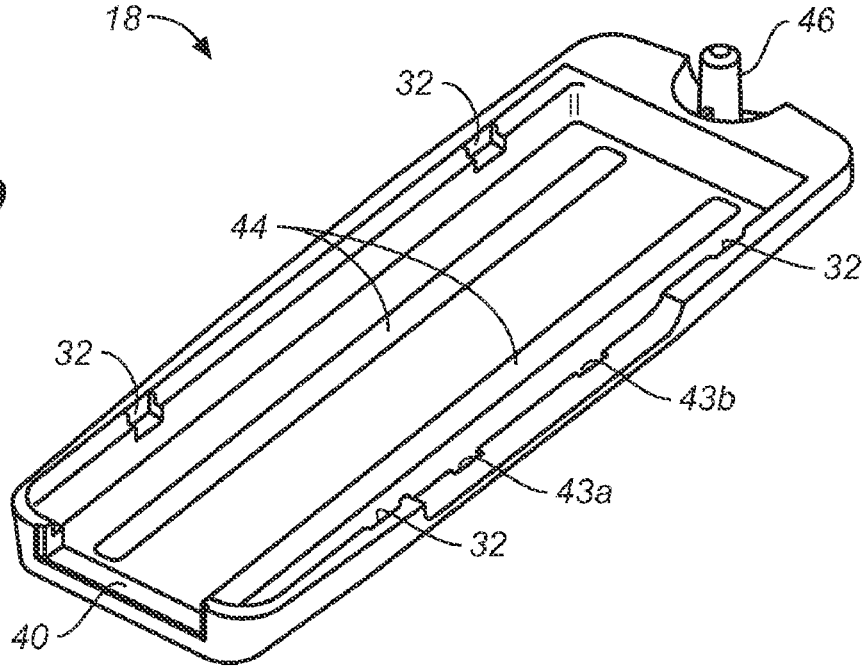
FIG. 4*b* illustrates the inside portion of the bottom casing.

Referring to FIG. 3*c*, the protruded area 25 next to the button 11 locks with the detents 42*a*, 42*b*, 43*a*, 43*b* (as shown in FIGS. 4*a* and 4*b*) on the top and bottom casings.

Figure 3D:
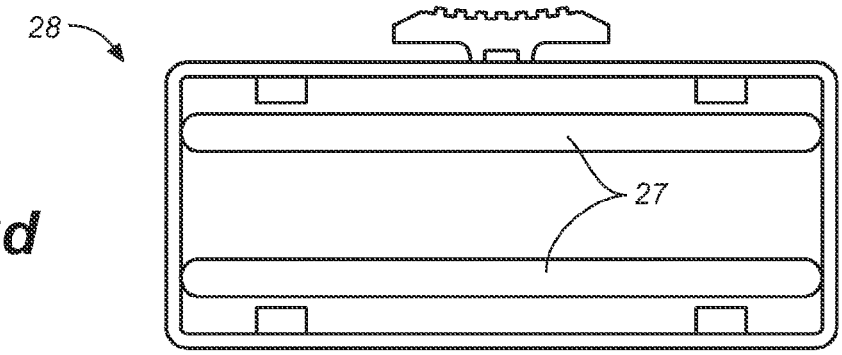

Referring to FIG. 3*d*, the guided rails 27 at the bottom of the middle carrier 28 keep the middle carrier 28 in place while it is sliding back and forth. The USB connector and memory device 14 shown in FIG. 2 is attached using the clamps 29. Accordingly, no screws are required to lock the connector and memory device 14, to the middle carrier 28.

FIG. 4*a* illustrates the inside portion of the top casing 16. FIG. 4*b* illustrates the inside portion of the bottom casing 18. The top casing 16, and the bottom casing 18 provide an opening 40 for the USB connector and memory device 14 to extend through. Both the top casing 16 and the bottom casing 18 have detents 42 that catch the protrusion 25 of the middle carrier 28 to lock the USB connector and memory device 14 in place when the middle carrier is slid back and forth. The bottom casing 18 has guided rail indents 44 that mate with the rails 27 on the middle carrier 18. The bottom casing 18 also provides a system for attaching a strap to USB drive 10 by utilizing an extended bar 46 from the bottom casing 18 that connects with a circular indent 48 on the top casing 16.

Figure 5:
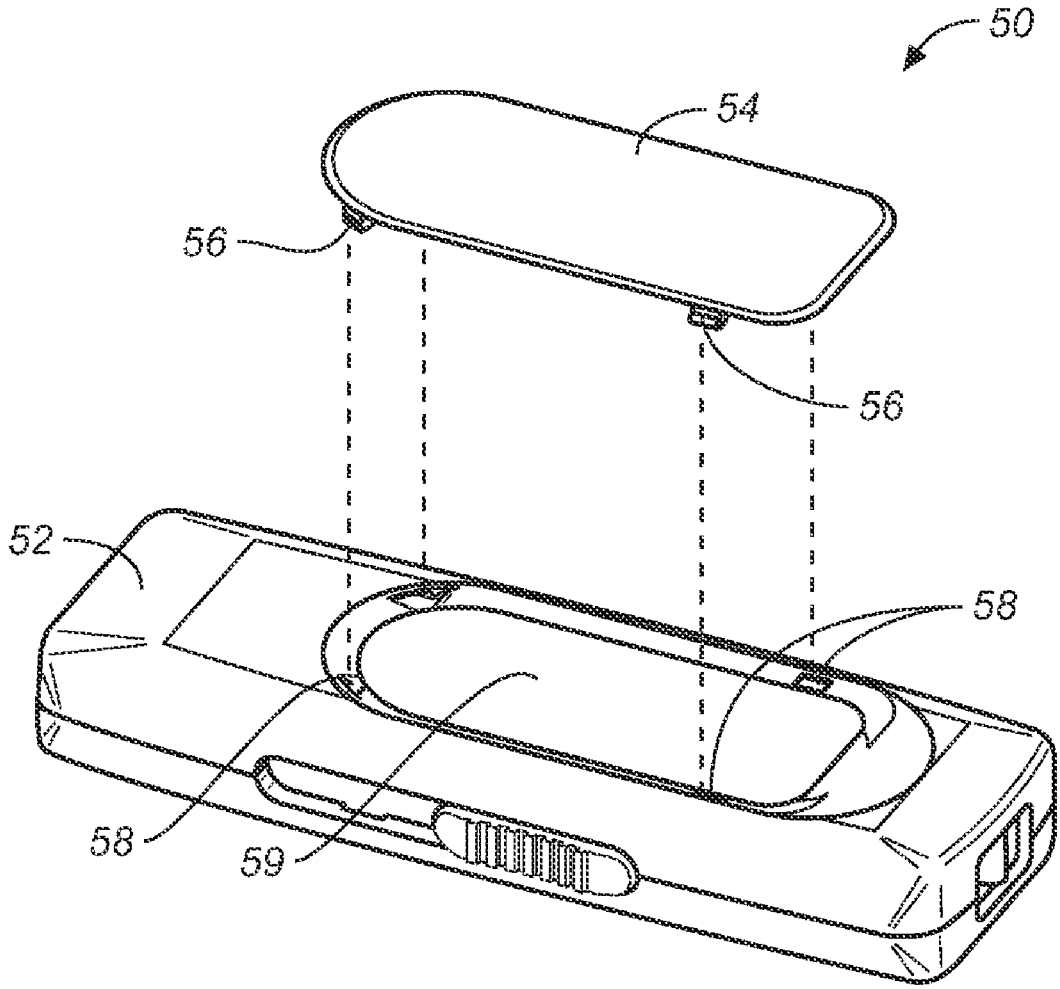
FIG. 5 shows a second embodiment of the USB retractable drive in accordance with the present invention.

FIG. 5 shows a second embodiment of the USB retractable drive 50 in accordance with the present invention. The top casing 52 has a concave cavity 59 with a removable clear piece cover 54 where a face plate can be inserted. This removable cover 54 allows the user to remove the cover 54 and place logos of any kind, personal favorite pictures, and user specific information in the cavity 59. The clear piece cover 54 protects the exchangeable face plate and has latches 56 that lock into holes 58 on the top casing 52. The USB connector and memory device 14 is not shown in FIG. 5, but it functions in the same manner as in the first embodiment described above.

Figure 6A:
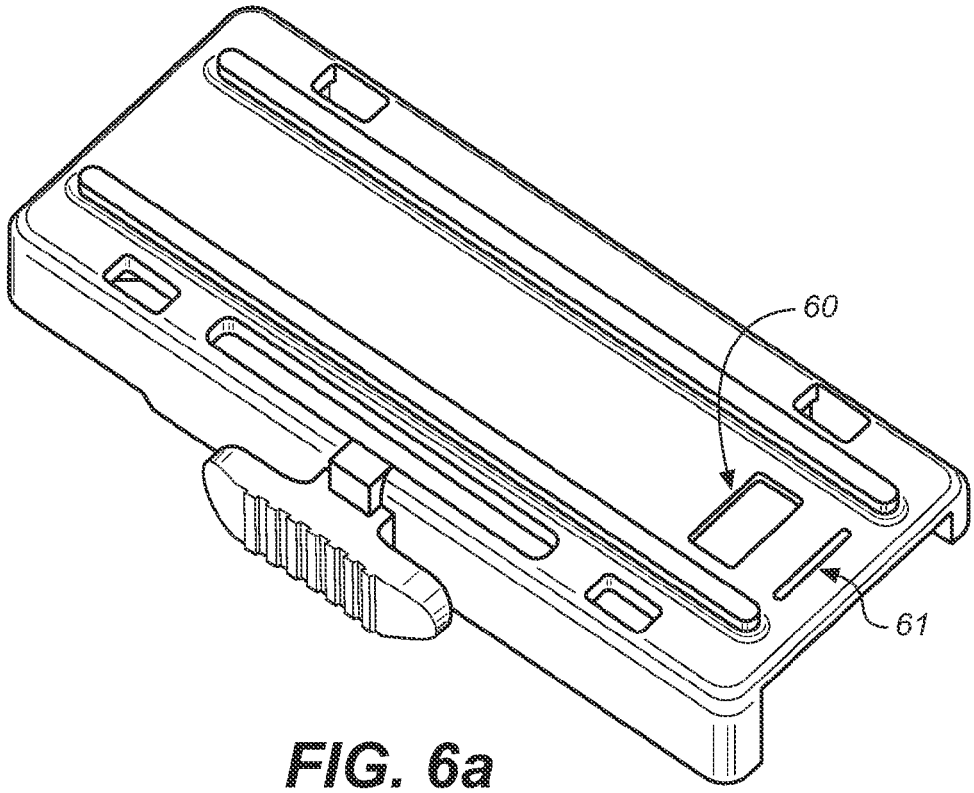
FIG. 6*a* shows a bottom view of a middle carrier.
Figure 6B:
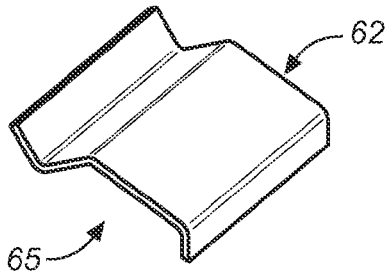
FIGS. 6*b* and 6*c* show the metal spring clip.
Figure 6C:
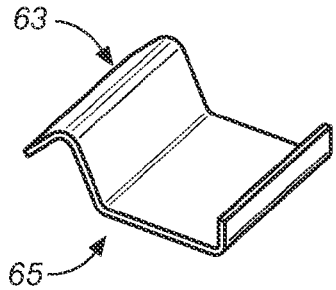
Figure 6D:
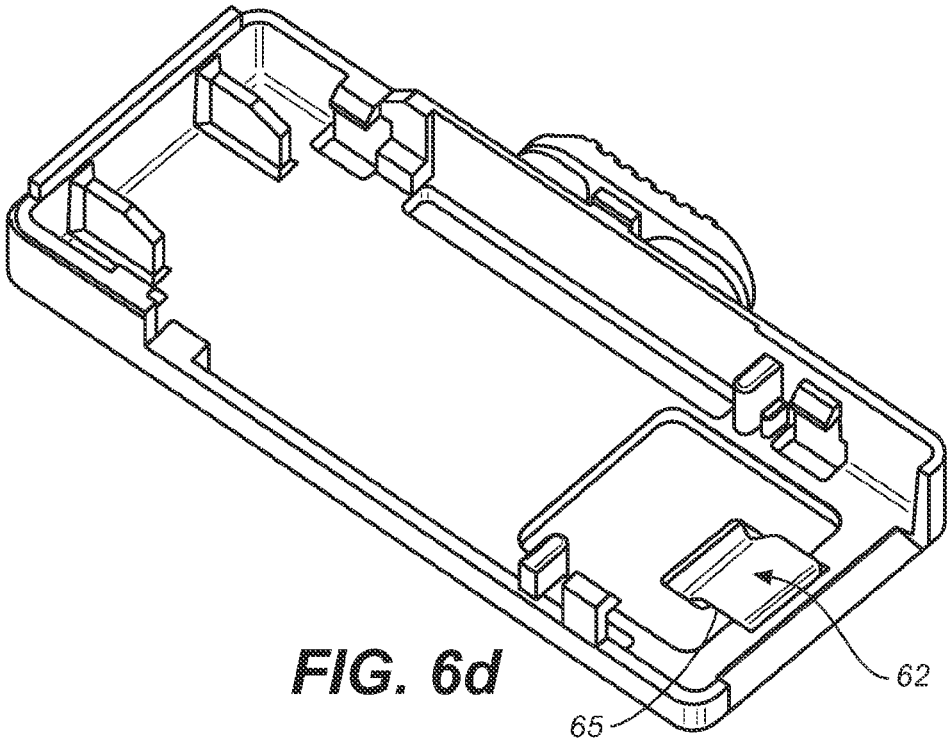
FIG. 6*d* shows the top view of the spring clip assembled on the middle carrier.
Figure 6E:
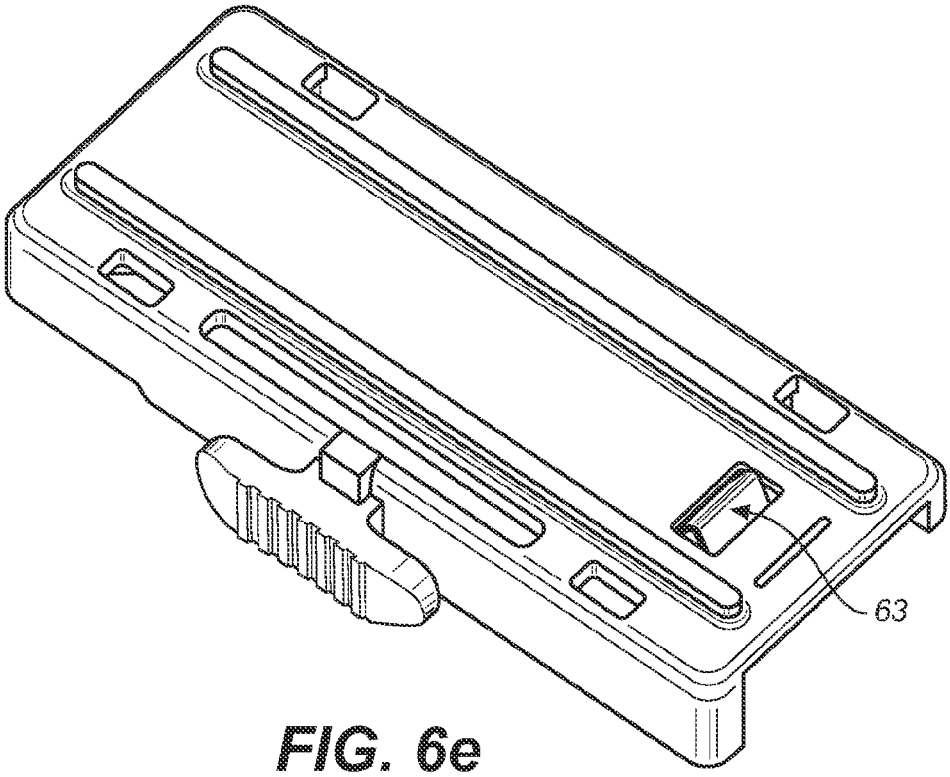
FIG. 6*e* shows the bottom view of the spring clip assembled on the middle carrier.

FIG. 6*a*-6*e* illustrate a third embodiment of a USB retractable device. Conventional USB drives typically place the EMI tape or gasket on the metal casing to improve Electromagnetic Interference. It is desirable to provide a simple way to improve both Electromagnetic Interference (EMI) and Electrostatic Discharge (ESD) on the device. This embodiment provides a better EMI and ESD protection. FIG. 6*a* illustrates the bottom view of a middle carrier 28 with small opening 60 and 61, so that a metal spring clip 65 as shown in FIGS. 6*b* and 6*c* can be properly attached. FIG. 6*d* illustrate the top surface 62 of the metal spring clip 65 on the middle carrier. The purpose of the top surface 62 is to contact with the USB connector of the memory device 14. FIG. 6*e* illustrates the bottom surface 63 of the metal spring clip 65 on the bottom of the middle carrier. The purpose of the bottom surface 63 is to contact with the lower casing 18. In this case, the lower casing 18 and upper casing 16 are both metal. With this approach, continuity between the memory device 14 and the casings 16 and 18 is achieved to provide a better EMI and ESD.

Figure 7:
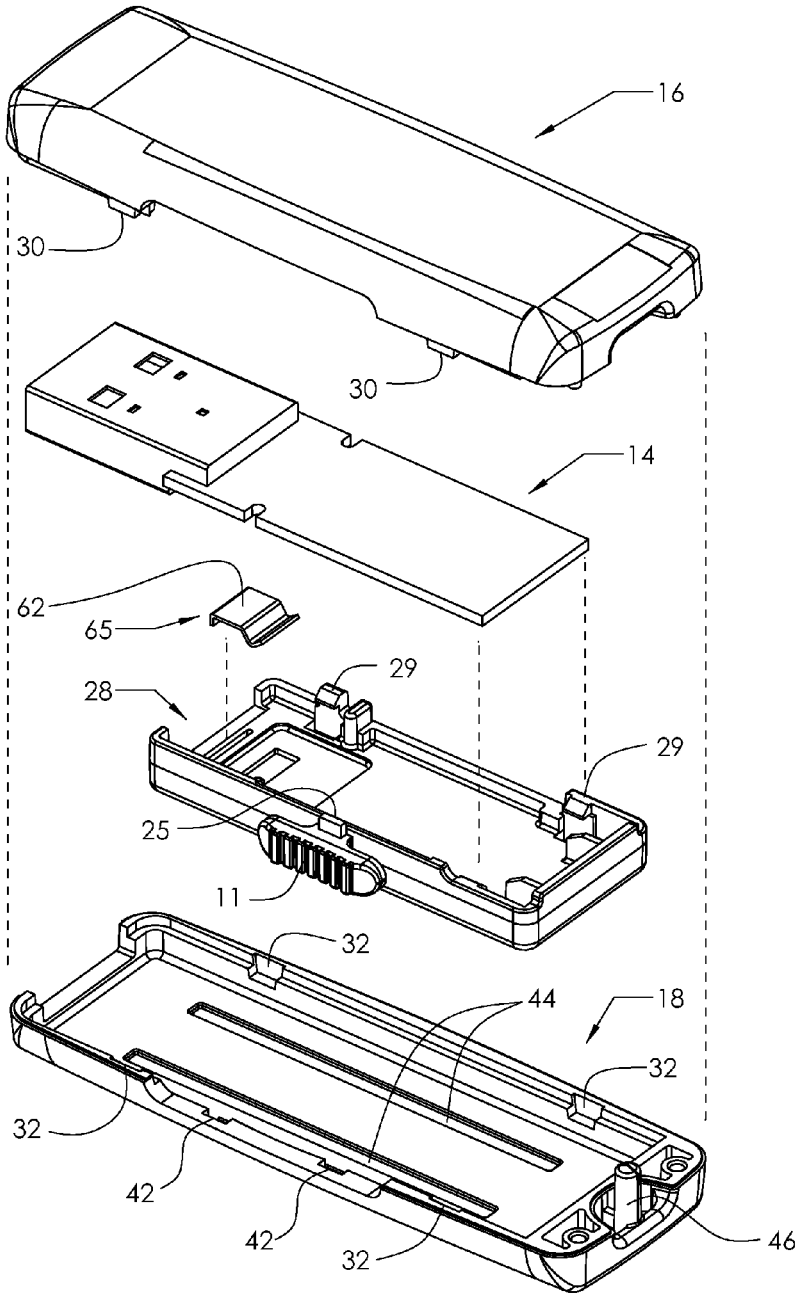
FIG. 7 shows an exploded view of the of the retractable USB drive.

FIG. 7 is an exploded view of the retractable USB drive 10 according to an exemplary embodiment. As is seen, the drive 10 includes an upper casing 16, a lower casing 18, a middle carrier 28, the USB connector and memory device 14 and the metal spring clip 65. Similarly as described in the above embodiments, there are no parts required to couple the USB drive 10 together and hold the USB connector and memory device 14 in place. There are no loose pieces when the top casing 16 is combined with the bottom casing 18. The top casing 16 is coupled to the bottom casing 18 by insertion of protrusions 30 on the upper casing 16 into the indentations 32 on the bottom casing 18. Once insertion is completed, with the USB connector and memory device 14 in place, the upper casing 16 and the lower casing 18 are preferably ultrasonically welded together by means of an ultrasonic tool. It should be understood that other processes could be utilized to couple the upper casing 16 and lower casing 18 together, such as providing a simple latching mechanism, therebetween or the like.

ADVANTAGES

The retractable USB drive in accordance with the present invention has the following advantages over conventional USB retractable drives:

1. drive in accordance with the present invention provides a simple way of retracting the USB drive.
2. The drive features a simple design, which facilitates ease of manufacturing, thereby providing a cost effective solution.
3. Less components are needed to manufacture the drive. No complex parts or springs are required.
4. The drive has less moving parts than conventional USB retractable drives. The only moving part of the device is the middle carrier.
5. The drive is more reliable than conventional USB retractable drives, since it utilizes built-in guide rails to prevent upward force when sliding.
6. The drive allows for sliding motion which is smooth on a mated guide rail between the lower casing and middle carrier.
7. In one embodiment, an opening is provided on the top cover of the drive for adding logo or user specific information after manufacturing.
8. A post that mates between the top and bottom casings allows for installation of a strap for carrying the drive.
9. The middle carrier can hold and support the USB connector and memory device within the casings with no screws through a latching mechanism.
10. Provide a simple way to improve EMI (Electromagnetic Interference) and ESD (Electrostatic Discharge) on the same middle carrier.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A memory drive comprising:

a first casing;

a second casing coupled to the first casing, wherein the first and second casings form a casing structure;

a carrier located in an opening between the casing structure containing a USB connector and a memory device;

a metal spring clip coupled to the USB connector to provide improved EMI and ESD protection, wherein the metal spring clip comprises a top surface for contacting with the USB connector of the memory device and a bottom surface for contacting with the second casing for providing continuity between the memory device and the casing structure, wherein the metal spring clip cooperates with a groove and an opening of the carrier when coupled with the carrier; and a sliding and locking mechanism on the carrier for extending and retracting a memory the memory device and USB connector on the carrier from and to the casing structure;

wherein the carrier includes an activation slide button which extends beyond the casing structure; and wherein the carrier includes guide rails to allow the carrier to slide back and forth in the casing structure.

2. The memory drive of claim 1 wherein the casing structure includes two detents, wherein the button is engaged with the one of the two detents when the memory device and connector is in an extended position; and when the button is engaged with the other of two detents the memory device and connector is in a retracted position.

3. The memory drive of claim 2 wherein pressing the button disengages the button from the two detents.

4. A USB drive comprising:

a top casing;

a bottom casing coupled to the top casing, wherein the top and bottom casings form a casing structure; wherein the casing structure includes two detents;

a middle carrier located in an opening within the casing structure, the middle carrier for containing a memory device and a USB connector, wherein the middle carrier includes an activation slide button which extends beyond the casing structure, wherein the button is engaged with the one of the two detents when the memory device and the USB connector is in an extended position; and when the button is engaged with the other of two detents the memory device and the USB connector is in a retracted position;

a metal spring clip coupled to the carrier for contacting the USB connector of the memory device to provide improved EMI and ESD protection, wherein the metal spring clip comprises a top surface for contacting with the USB connector of the memory device and a bottom surface for contacting with the bottom casing for providing continuity between the memory device and the casing structure, wherein the metal spring clip cooperates with a groove and an opening of the middle carrier when coupled with the middle carrier; and a sliding and locking mechanism on the middle carrier to allow for extending and retracting the memory device and USB connector from and to the casing structure based upon the position of the button;

wherein the middle carrier includes guide rails to allow the middle carrier to slide back and forth in the casing structure.

5. The USB drive of claim 4 wherein pressing the button disengages the button from the two detents.

6. The memory drive of claim 1 wherein the sliding and locking mechanism comprises a protrusion extending from the carrier.

7. The memory drive of claim 6 wherein the activation slide button is coupled to the protrusion.

* * * * *